US009869144B2

(12) United States Patent
Sipos

(10) Patent No.: US 9,869,144 B2
(45) Date of Patent: Jan. 16, 2018

(54) GATE ELEVATOR

(71) Applicant: David L. Sipos, Youngsville, LA (US)

(72) Inventor: David L. Sipos, Youngsville, LA (US)

(73) Assignee: Vermilion River Tool and Equipment Company, Lafayette, LA (US)

( * ) Notice: Subject to any disclaimer, the term of this patent is extended or adjusted under 35 U.S.C. 154(b) by 508 days.

(21) Appl. No.: 14/445,972

(22) Filed: Jul. 29, 2014

(65) Prior Publication Data

US 2015/0027733 A1 Jan. 29, 2015

Related U.S. Application Data

(60) Provisional application No. 61/859,456, filed on Jul. 29, 2013.

(51) Int. Cl.
*E21B 19/06* (2006.01)

(52) U.S. Cl.
CPC ..... *E21B 19/06* (2013.01)

(58) Field of Classification Search
CPC ..... E21B 19/06
See application file for complete search history.

(56) References Cited

U.S. PATENT DOCUMENTS 1,558,261 A * 10/1925 Grady ..... E21B 19/06 294/91
2,946,464 A * 7/1960 Guier ..... E21B 19/14 414/22.68
3,461,666 A 8/1969 Bursiall
4,441,749 A 4/1984 Blaschke et al.
4,800,968 A 1/1989 Shaw et al.
7,303,021 B2 12/2007 Schats et al.
7,434,614 B2 * 10/2008 Nelson ..... E21B 19/06 166/379
7,735,565 B2 6/2010 Wells et al.
7,762,343 B2 7/2010 Sonneveld et al.
7,992,909 B2 8/2011 Bouligny, Jr. et al.
8,141,923 B2 3/2012 Bouligny et al.
8,146,671 B2 4/2012 Sipos
8,267,450 B2 9/2012 Aarhus et al.

FOREIGN PATENT DOCUMENTS

EP 1712728 9/2008

* cited by examiner

*Primary Examiner* — Cathleen R Hutchins
*Assistant Examiner* — Ronald R Runyan

(57) ABSTRACT

A shoulder elevator having a gated pipe opening is disclosed. The elevator has a ringed body having unclosed sector creating an opening for receiving a pipe within the body ring. Pivotally mounted gates positioned on opposite sides of the unclosed sector of the ringed body, move in unison to an open and partially close the unclosed sector of the ringed body around the pipe in response to pipe contact with rearward end of the gates. A lever is provided to manually pivot the gates to an open and closed position around a pipe. Lifting lugs or ears are provided to attach the elevator to the lifting links of a hoist.

5 Claims, 9 Drawing Sheets

GATE ELEVATOR

PRIORITY

This application claims priority to U.S. provisional application Ser. No. 61/859,456 filed Jul. 29, 2013 entitled "Gate Elevator", the entire content of which is hereby incorporated by reference.

FIELD OF INVENTION

This invention generally relates to oil well casing handling devices typically referred to as elevators. More particularly, it relates to an improved shoulder elevator having a gated entranceway for lifting oilfield tubulars such as casing pipe.

BACKGROUND

Elevators and spiders are typically arranged in alignment with an opening in the rotary table on the working platform of an oil well derrick. The elevator is used to hold, lower, and raise tubular pipe segments sometimes comprised of multiple lengths of pipe. The elevator is used to grip, lift, and release a pipe segment, in cooperation with the spider, with each pipe segment added to or removed from the pipe string in the well bore. Such pipe string may be a string of casing pipe, liner pipe, or drill pipe.

Each pipe segment typically has a threaded connection at each end with one end having an internally threaded band called a collar that protrudes or extends outward around the periphery of the pipe segment. The annular surface at the base of the collar between the outer periphery of the collar and the periphery of pipe is called the shoulder of the collar. An elevator supporting a pipe segment or a string of pipe segments on the shoulder of a collar is called a shoulder-type elevator.

An elevator and its components are subjected substantial stress, strain, and fatigue during use due to the repeated loadings from the weight of the pipe segments. Dropping a pipe segment can cause severe damage to rig equipment and injury to rig workers.

It would be an advantage to have an elevator designed with a minimum of components and with the components robustly configured to withstand the repeated loadings associated with continuous use in lifting and supporting the pipe segments to minimize failure and the cost associated with elevator replacement and repair. It would also be an advantage to provide an elevator that will safely secure a pipe segment within the elevator and minimize the steps needed for its use to enhance the safety of workers on the rig floor.

SUMMARY

An open ring shoulder-type elevator is described. The elevator has a frame or body comprised of a partial circle or ring of a desired inner and outer radius. The unclosed sector of the body or ring creates an entrance into the body ring for insertion of a length of pipe. A pivotable gate is mounted on the elevator body on opposing sides of the entrance. Hangers or ears are provided on the body ring for attachment of the bails or links of a hoist.

The pivotally positionable gates are spring biased to an open position so that the entrance into the body ring is open. The gates are pivoted simultaneously to a closed position upon contact with a pipe segment inserted into the ring body. When the gates are in a closed position, the entrance into the body ring is at least partially closed by the pivoting gates. A manual, lever operated, safety latch mechanism is provided to assist in pivoting the opposing gates to an open and closed position and in securing the gates in the closed position.

To use the elevator described herein, an operator uses the lever and latch mechanism to pivot the opposing gates manually to the open position. When the gates are in the open position, the unclosed sector or entrance of the elevator will tilt downward on the hanger. The elevator is then positioned so that a pipe segment may be received through the entrance into elevator body ring. If a pipe segment to be lifted is positioned horizontally or at an angle, when the pipe segment is received into the body ring of the elevator, the weight of the elevator against the pipe segment will cause the opposing gates to pivot to a closed position at least partially closing the gates around the pipe segment without further operator assistance. The safety latch may then be secured to prevent opening of the gates. The elevator may then be hoisted on the hangers to allow the closed elevator to slide along the pipe to a position where the pipe collar is supported on the opposing gates so that the pipe segment may be lifted. If the pipe segment is vertical, it will be necessary for the operator to pull the elevator onto the pipe segment through the entrance and then tilt the elevator back to level so that the elevator will swing against the pipe segment to pivot the opposing gates to a closed position around the pipe segment.

To remove the elevator from the pipe segment, the operator need only trip the safety latch lever and the opposing gates will pivot to an open position by means of the biasing spring. The elevator may then be moved from around the pipe segment through the unclosed sector or entrance into the elevator body ring. If the pipe segment is vertically oriented, the operator must push the elevator away from the pipe segment through the unclosed sector. If the pipe is horizontal or angled, the elevator may simply be lifted from the pipe segment through the unclosed sector or entrance by the hoist away.

DRAWINGS

DESCRIPTION

Figure 1:
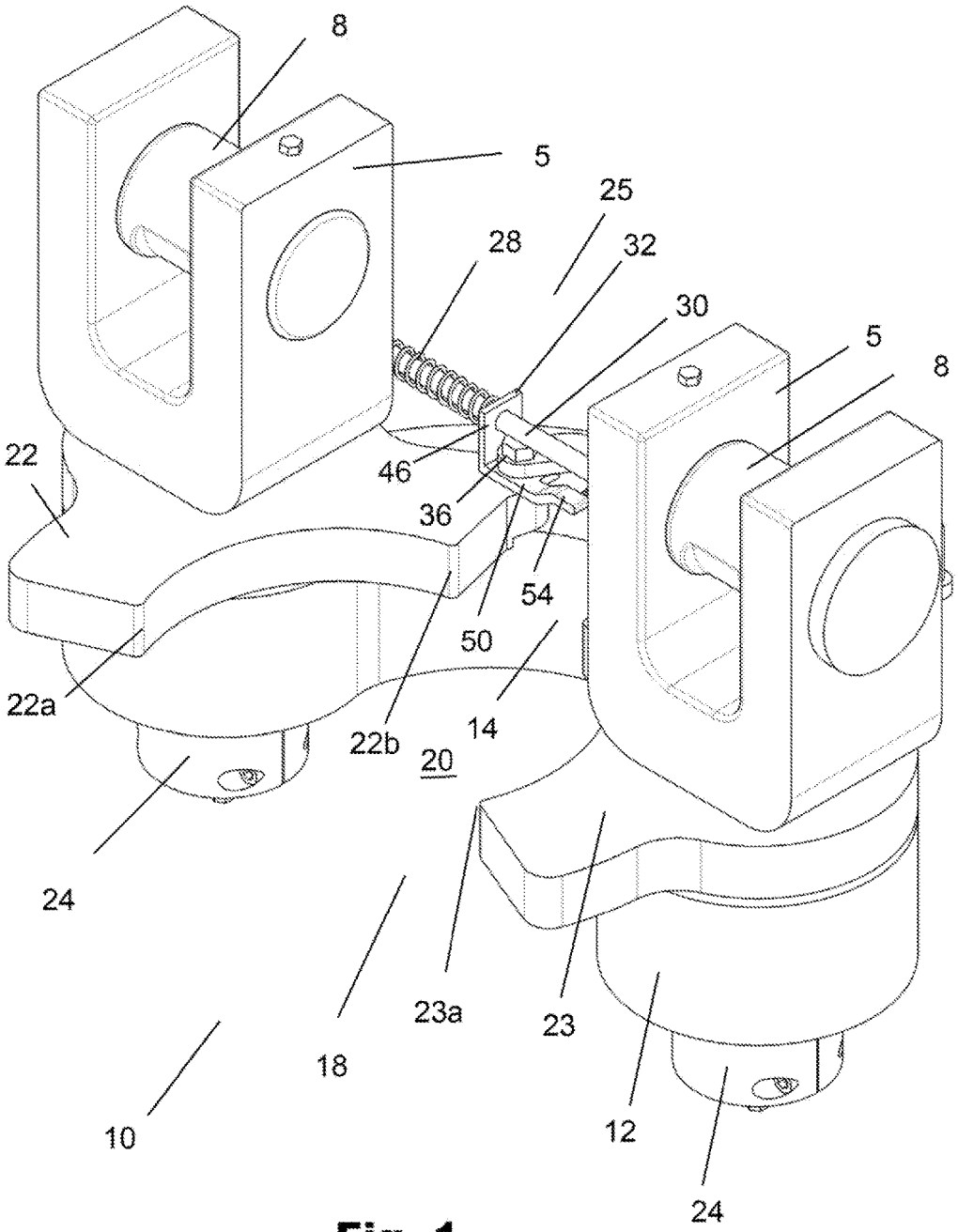
FIG. 1 is a front perspective view of the gated elevator of the present invention in an open position in advance of receiving a pipe.
Figure 2:
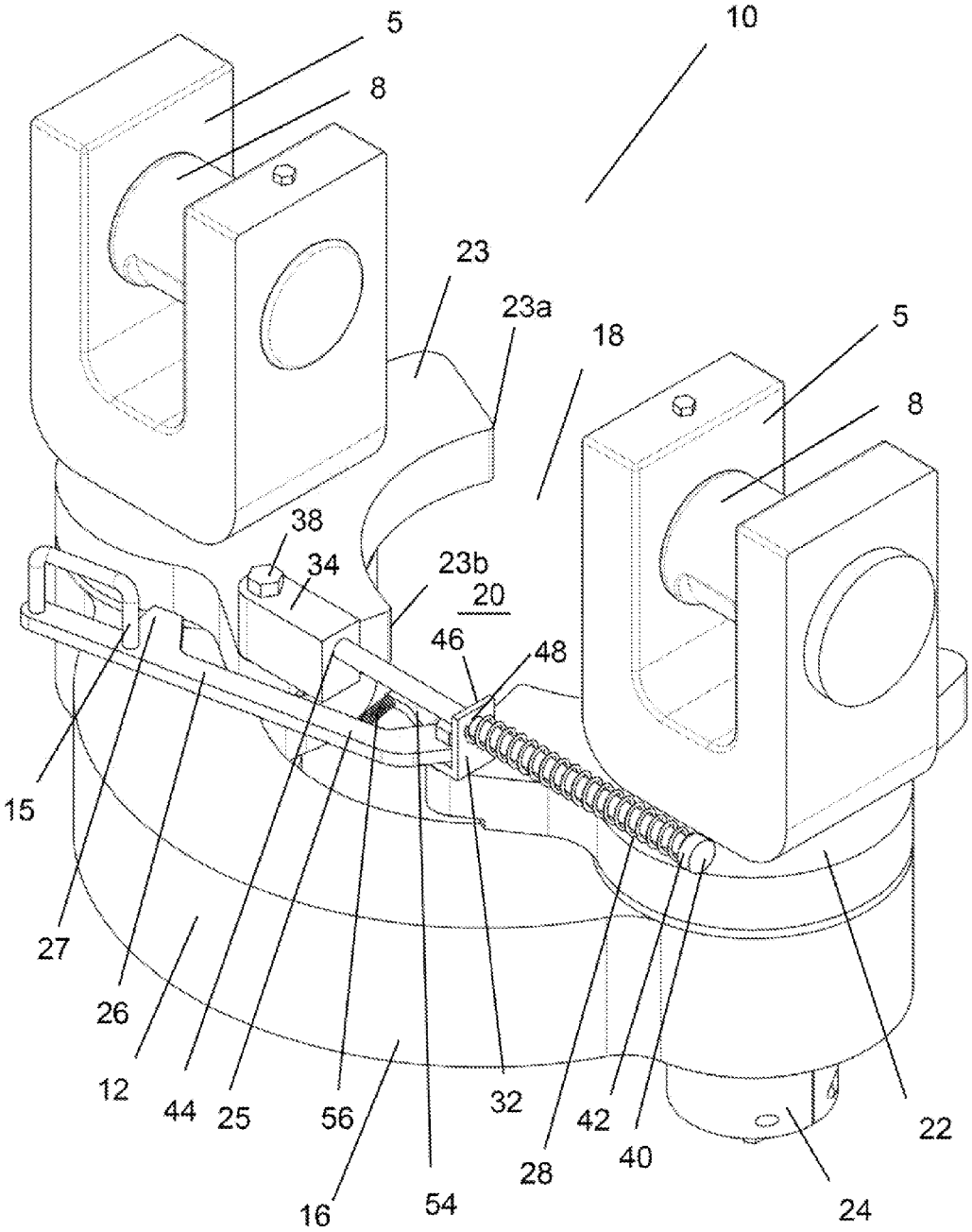
FIG. 2 is a rear perspective view of the gated elevator of the present invention in an open position in advance of receiving a pipe.
Figure 3:
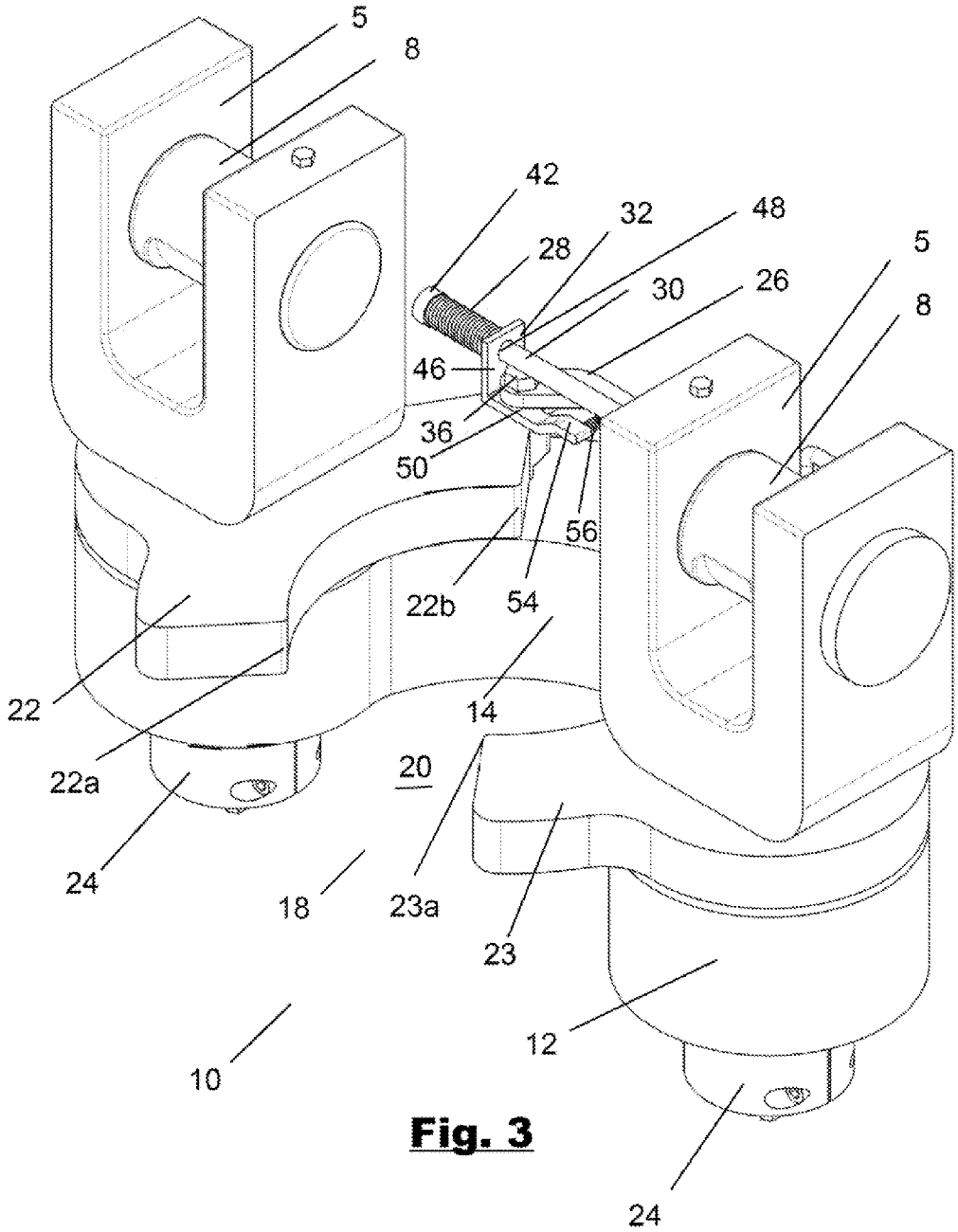
FIG. 3 is a front perspective view of the elevator of FIG. 1 in a closed position.
Figure 4:
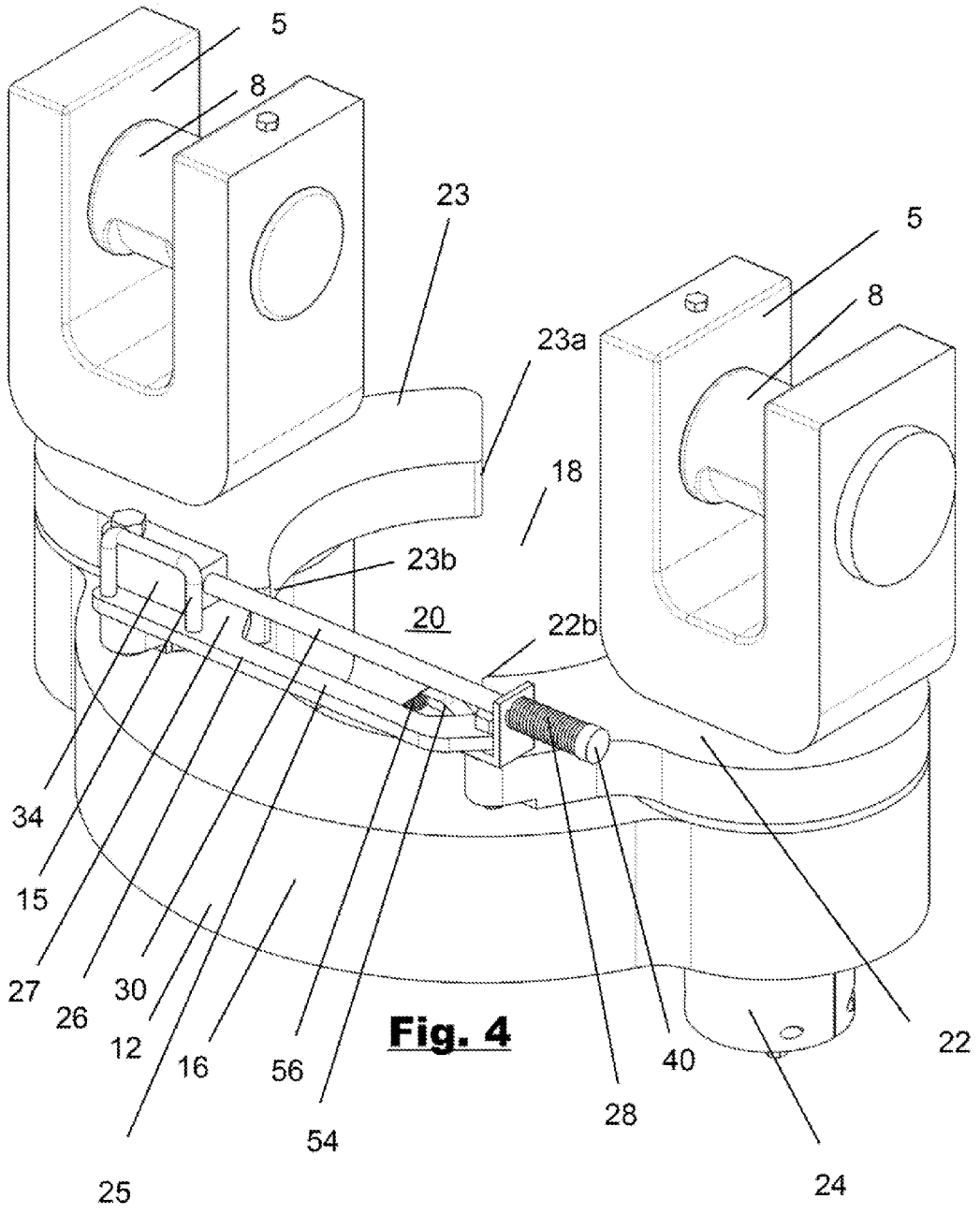
FIG. 4 is a rear perspective view of the elevator of FIG. 1 in a closed position.

FIGS. 1 through 4 show front and rear perspective views of an embodiment of the gated shoulder-type elevator of Applicant's invention used for lifting a pipe segment by its protruding collar. FIGS. 1 and 2 show the gated elevator in an open position. FIGS. 3 and 4 show the gated elevator in a closed position.

The elevator (10) has a partially ringed frame or body (12) disposed on hangers (5). The hangers (5) allow the elevator (10) to be pivotally suspended by hanger pins (8) on bails or links that are attached to a hoist not shown) for lifting a pipe segment. The ringed body (12) has an inner radius (14) and outer radius (16) with an unclosed or open sector (18) into the central area (20) created by the body ring (12). Pivotally attached to the body (12) is first inwardly curved gate (22), having a forward end (22*a*) extending toward said open sector (18) and rearward end (22*b*) extending away from said open sector (18), and an opposing second inwardly curved gate (23), having a forward end (23*a*) extending toward said open sector (18) and rearward end (23*b*) extending away from said open sector (18). The gates (22, 23) are pivotally mounted with the ringed body (12) near their center on opposite sides of the central area (20) by their respective pivot pins (24).

Figure 7:
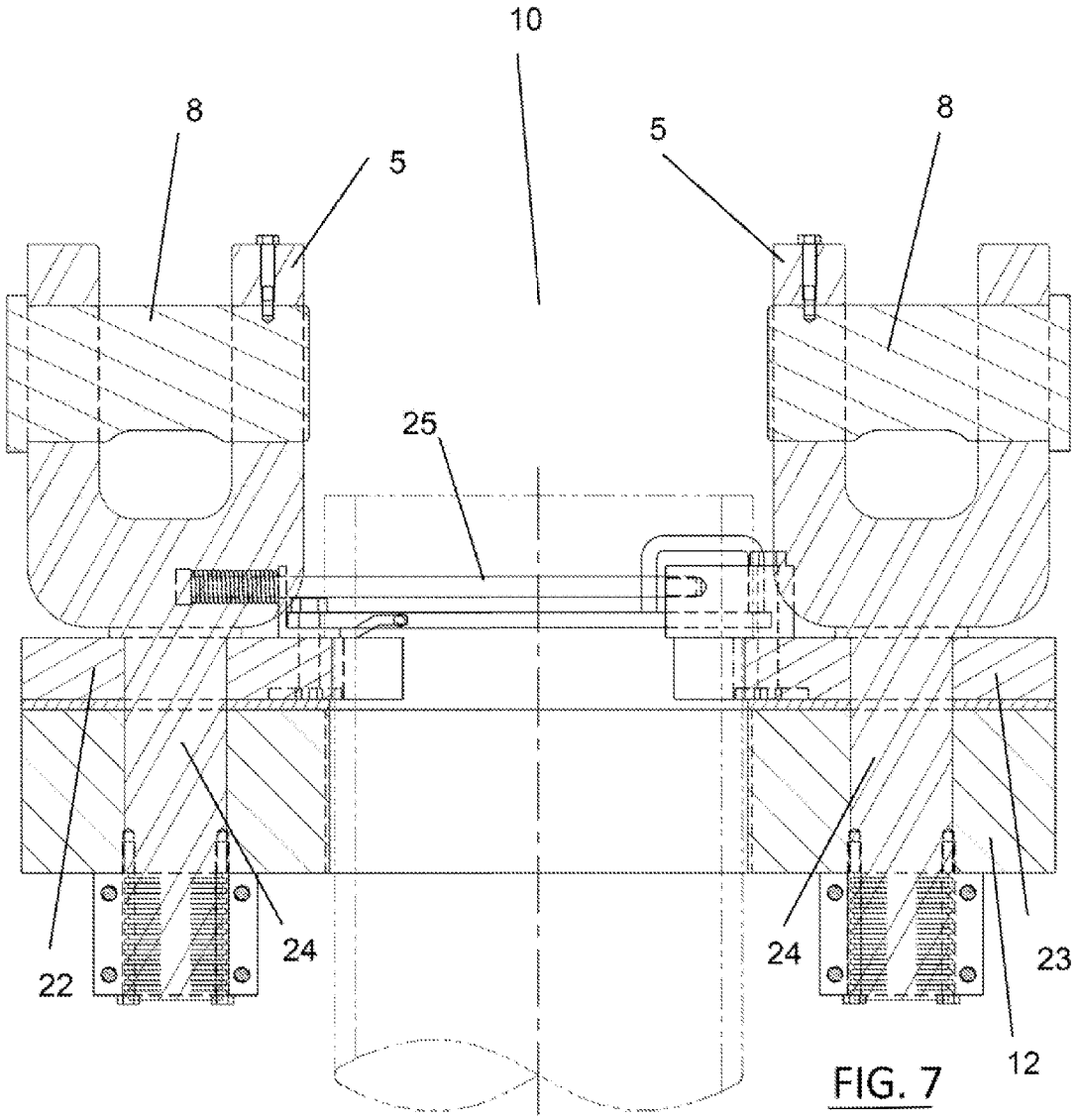
FIG. 7 is a vertical cross-section view of the elevator of FIG. 1 in a closed position.

The forward ends (22*a*, 23*a*) of gates (22, 23, respectively) may be rotated in unison on the ringed body (12) about its respective mounting pin (24) to both open, and to at least partially close, the open sector (18) of the ringed body (12) that leads into the central area (20). The hangers (10) are positioned on the ringed body (12) so that the elevator remains horizontally level when the forward ends (22*a*, 23*a*) of gates (22, 23) are rotated to a closed position to narrow or close the open sector (18). When the forward ends (22*a*, 23*a*) of opposing gates (22, 23) are rotated to an open position to widen or expand the open sector (18), the elevator (10) will tilt on hangers (5) towards the open sector (18). A vertical cross-section view of the elevator (10), with the both (12) disposed on hangers (5) and with the gates (22, 23) pivotally mounted on respective pivot pins (24), is shown in FIG. 7.

Figure 5:
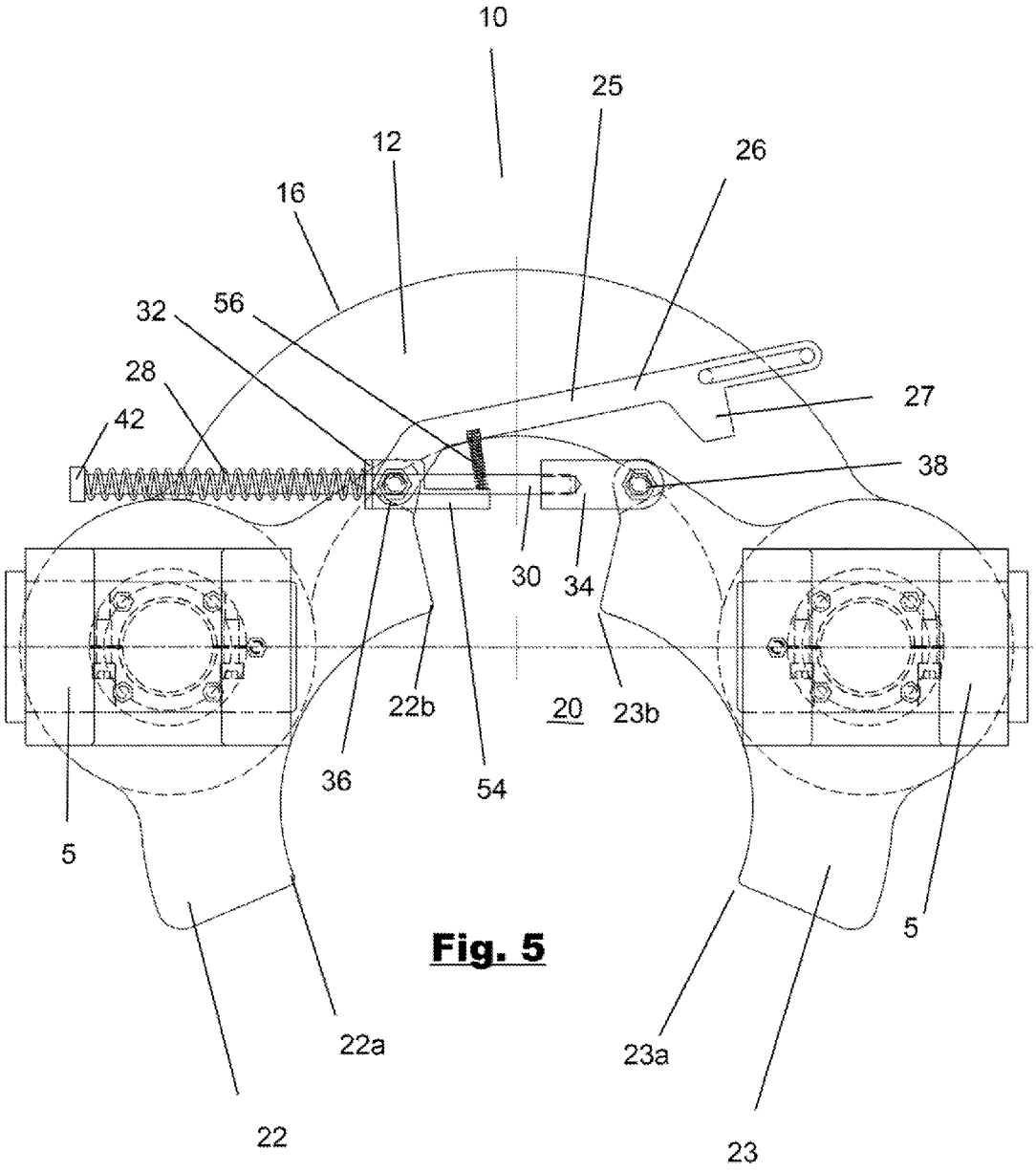
FIG. 5 is a top view of the elevator of FIG. 1 in an open position.

As shown in FIGS. 1, 2 and 5, opposing gates (22, 23) are spring biased to move in unison in an open position with respect to the open sector (18) of the ringed body (12) by means of latching mechanism (25). Latching mechanism (25) is comprised of a latch lever (26) having handle (15), a latch wedge (27), a latch spring (28), a latch spring guide rod (30), a latch lever spring stop (32), and a latch block (34). Latch lever (26) is pivotally mounted on the rearward end (22*b*) of gate (22) by means of latch lever pivot pin (36). Latch block (34) is pivotally mounted on the rearward end (23*b*) of gate (23) by means latch block pivot pin (38). The latch spring guide rod (30) has a first end (40) with a latch guide rod spring stop (42) and a second end (44) threadedly or otherwise attached to latch block (34).

Latch lever spring stop (32) is an L-shaped plate having an upward extending arm (46) with a bore (48) for receiving guide rod (30) and a horizontal arm (50) having a bore (52) for pivotal attachment of latch lever spring stop (32) on gate (22) also by means of latch lever pivot pin (36). Formed with arm (50) of latch spring stop (32) is lever arm (54). Lever arm (54) supports spring (56) extending between lever arm (54) and latch lever (26). Spring (56) provides a biasing force sufficient to bias latch lever (26) in an open position outward from the ringed body (12).

Latch spring guide rod (30) extends between opposing gates (22, 23) where it is slidably received into bore (48) of arm (46) of latch spring stop (32). Latch spring (28) is positioned on latch guide rod (30) to extend between arm (46) of spring stop (32) and latch guide rod spring stop (42). Latch spring (28) exerts a biasing force sufficient to rotate opposing gates (22, 23) on pivot pins (24) so that the rearward ends (22*b*, 23*b*) are rotated inward with respect to the central area (20) of the ringed body (12) thereby rotating the forward ends (22*a*, 23*a*) of opposing gates (22, 23) away from the open sector (18) of the ringed body (12) to an open position.

Figure 6:
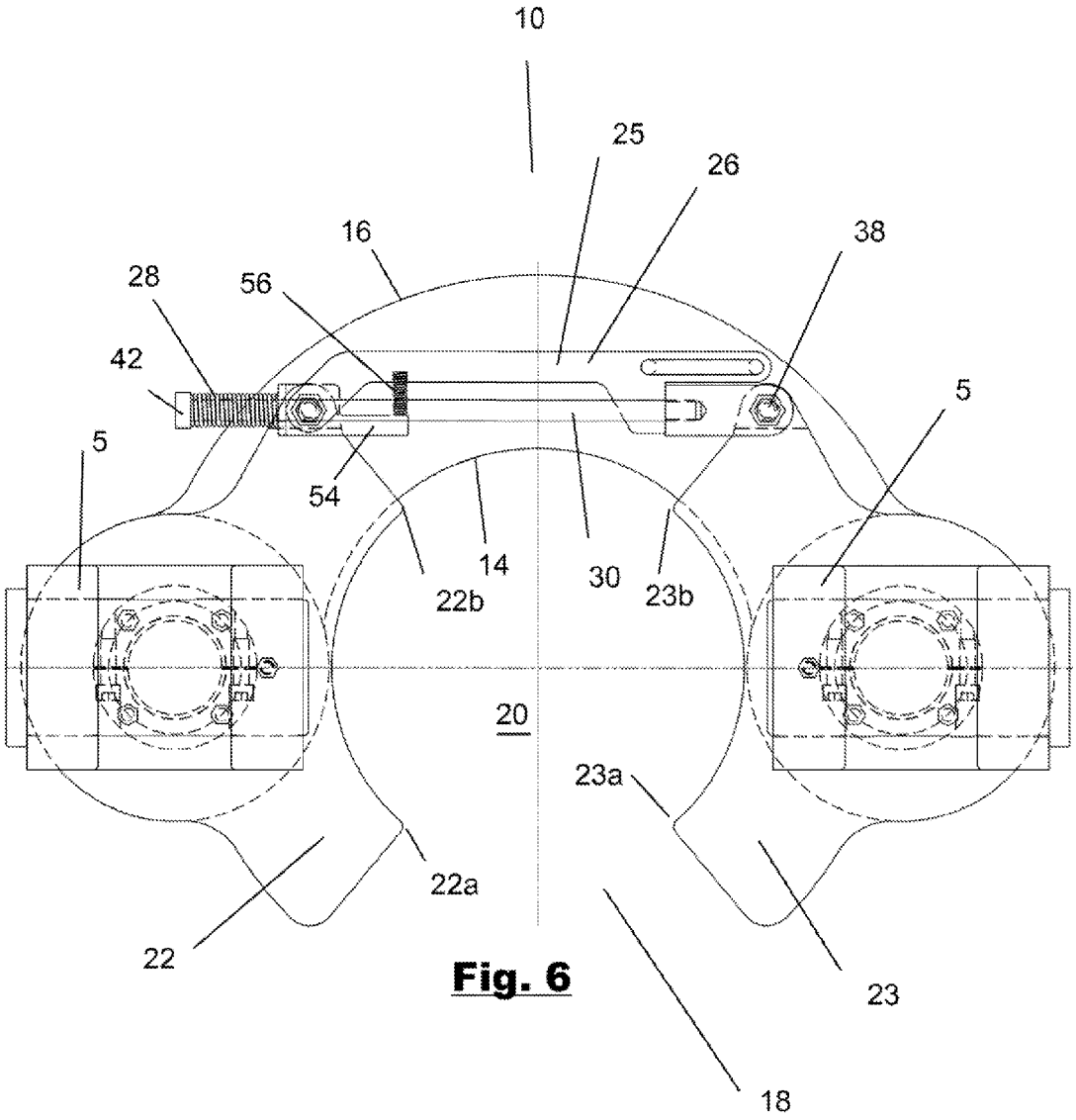
FIG. 6 is a top view of the elevator of FIG. 1 in a closed position.

Opposing gates (22, 23) may be moved into the open sector (18) of the ringed body (12) to a closed position as shown in FIGS. 3, 4 and 6 by applying a force to the rearward ends (22*b*, 23*b*) of at least one of the gates (22, 23) to compress latch spring (28). Because the gates (22,23) are linked by guide rod (30) of latch mechanism (25), contact with the rearward ends (22*b*, 23*b*) of at least one of the gates (22, 23) will pivot the gates (22, 23) on their respective pivot pins (24) to move rearward ends (22*b*, 23*b*) outward away from central area (20) to compress latch spring (28). As latch spring (28) is compressed, the forward ends (22*a*, 23*a*) of the gates (22, 23) move inward toward the central area (20) of the elevator (10).

The force to compress latch spring (28) and move the gates (22, 23) to a closed position may also be applied by manually by pushing the lever (26) inward toward the central area (20) of the elevator so that lever (26) rotates on latch lever pivot pin (36) to compress latch spring (28) so that latch wedge (27) bears upon latch block (34) to rotate the forward ends (22*a*, 23*a*) rearward and outward. Such rotation of latch lever (26) will then rotate the forward ends (22*a*, 23*a*) of opposing gates (22, 23) inward into the open sector (18) of the ringed body (12) to a closed position around a pipe segment. The latch block (34) may be curved to facilitate engagement with the latch wedge (27) of lever (26).

When the elevator (10) is being used, the gates (22, 23) can be moved in unison to a closed position around a pipe segment by positioning a pipe within the central area (20) of the elevator and either moving the elevator so that the weight of the elevator (10) on the gates (22, 23) against the pipe segment or the weight of the pipe segment against the gates (22, 23) will pivot the gates (22,23) on the respective pivot pins (24) to compress latch spring (28) and allow rotation of opposing gates (22, 23) on pivot pins (24) so that the rearward ends (22*b*, 23*b*) are simultaneously rotated outward away from the central area (20) of the ringed body (12) and the forward ends (22*a*, 23*a*) of opposing gates (22, 23) are rotated inward into the open sector (18) of the ringed body (12) to a closed position around the pipe segment.

When the forward ends (22*a*, 23*a*) of opposing gates (22, 23) are rotated inward to a closed position, the rearward ends (22*b*, 23*b*) of opposing gates (22, 23) may be secured from inward movement by the biasing force exerted on lever latch wedge (27) of latch lever (26) against latch block (34) by latch spring (28). A pin (not shown) removably positioned through latch lever (26) into ringed body (12) may be provided as an additional guard against unwanted movement of the latch lever (26) and the rearward ends (22*b*, 23*b*) of opposing gates (22, 23). Other similar safety mechanisms may also be utilized.

If the elevator (10) cannot be moved against the pipe to close the gates (22,23), the rearward ends (22*b*, 23*b*) of opposing gates (22, 23) may also be manually rotated outward by pushing latch lever (26) so that lever (26) rotates inward on latch lever pivot pin (36) toward the ringed body (12) to compress latch spring (28). Such rotation of latch lever (26) will then rotate the forward ends (22*a*, 23*a*) of opposing gates (22, 23) inward into the open sector (18) of the ringed body (12) to a closed position around a pipe segment. The elevator (10) can then be lifted on hangers (5)

to slide along the pipe until the protruding pipe collar engages with the gates (22, 23) for lifting the pipe and moving it as desired.

Figure 8:
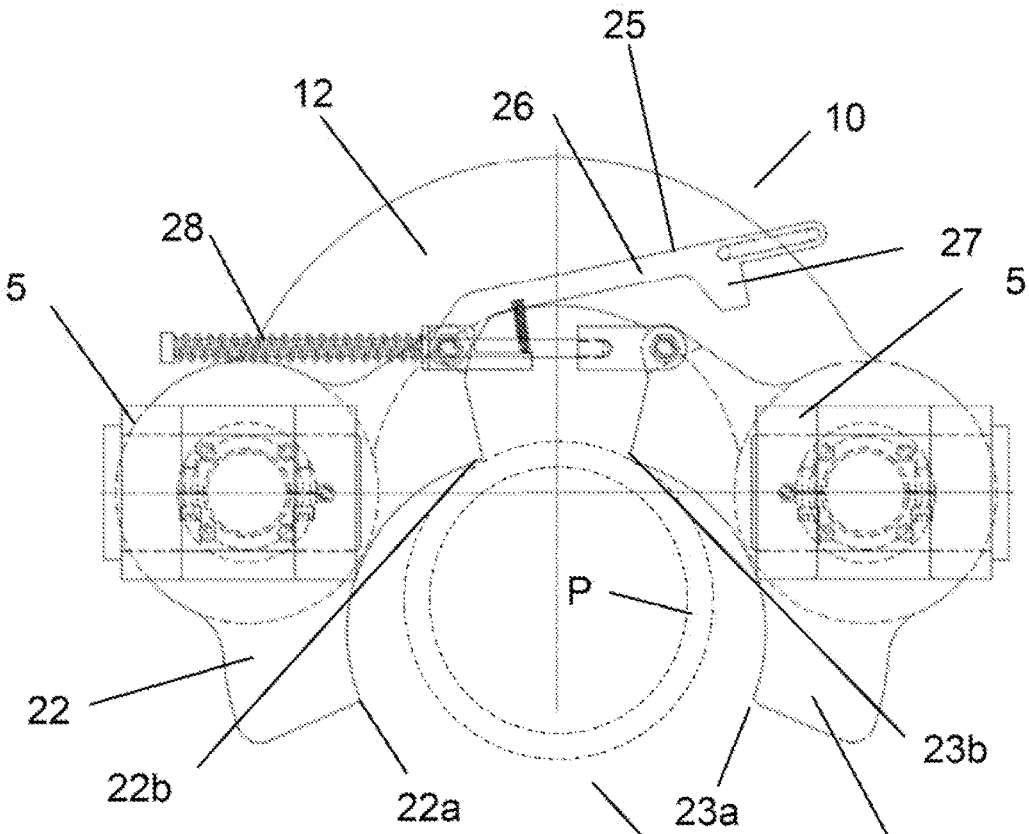
FIG. 8 is a top view of the gated elevator of FIG. 1 in an open position receiving a pipe segment.
Figure 9:
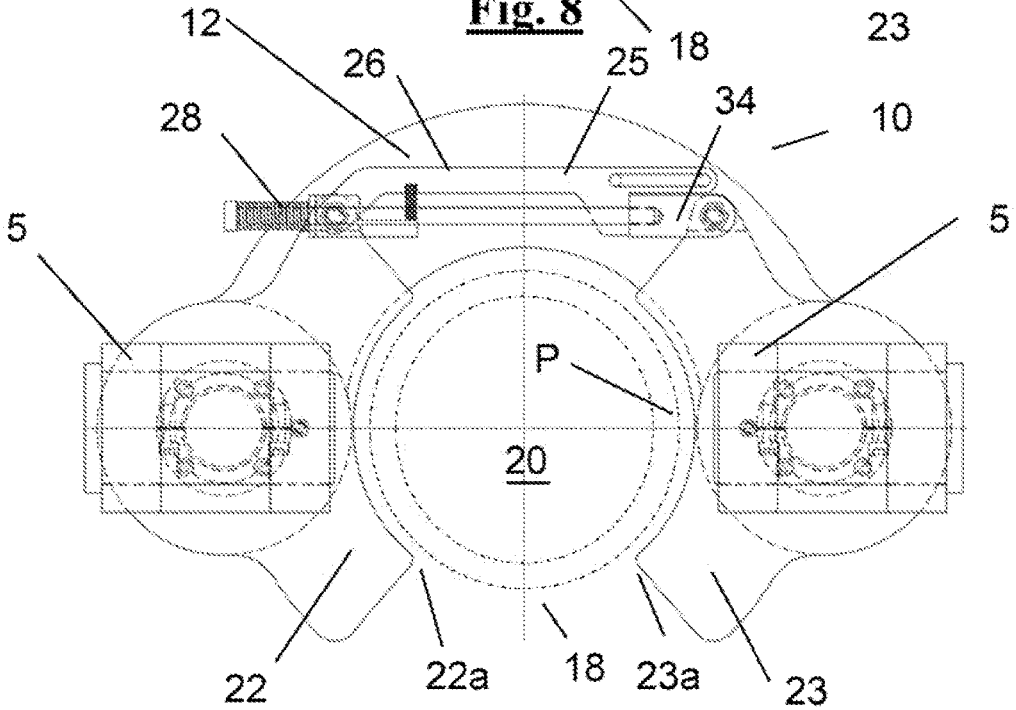
FIG. 9 is a top view of the gated elevator in a closed position around a pipe segment.

FIG. 8 shows a top view of the elevator (10) with the forward ends (22*a*, 23*a*) of opposing gates (22, 23) rotated to an open position around pipe segment (P) positioned within the central area (20) of the ringed body (12) of elevator (10). FIG. 9 shows a top view of the elevator (10) with the forward ends (22*a*, 23*a*) of opposing gates (22, 23) rotated to a closed position around pipe segment (P). The latching mechanism (25) is shown moved to its closed and locked position with lever latch wedge (27) of latch lever (26) in place against latch block (34).

To remove the elevator (10) from the pipe segment, the operator need only trip the latch lever (26) of the latching mechanism (25) to disengage it from block (34) and the gates (22, 23) will pivot by means of the biasing latch spring (28) to an open position. The elevator (10) may then be moved from around the pipe segment through the open sector (18) of the elevator ringed body (12). If the pipe segment is vertically oriented, the operator must push the elevator (10) away from the pipe segment. If the pipe segment is disposed horizontally or at an angle, the elevator (10) may simply be lifted on the hangers (5) by the hoist away from the pipe segment.

Figure 10:
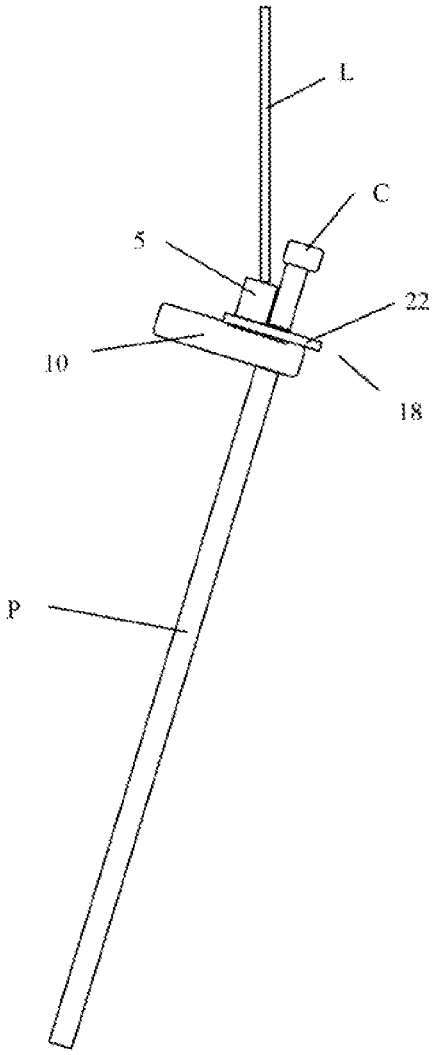
FIG. 10 is a schematic side view of the gated elevator of FIG. 1 open and tilted to receive a pipe segment.
Figure 11:
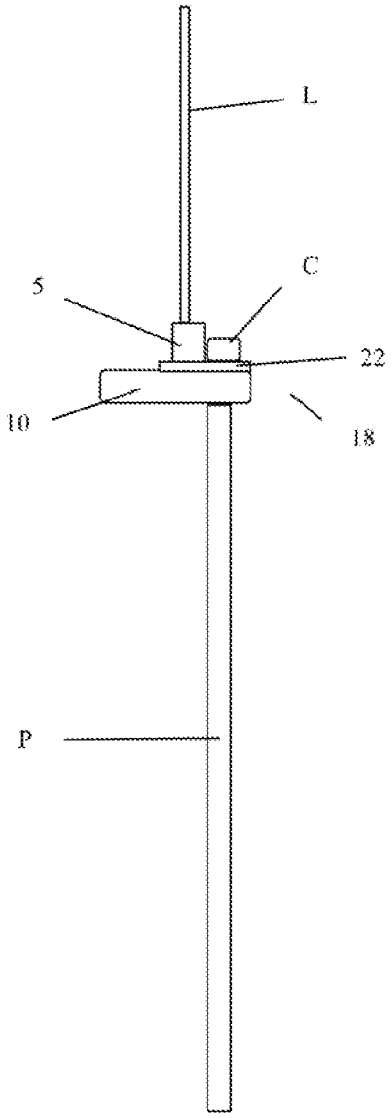
FIG. 11 is a schematic side view of the gated elevator of FIG. 1 closed and lifting a pipe segment.

FIGS. 10 and 11 are schematic side views showing the operating sequence for gripping a pipe (P) with the elevator (10). To grip a pipe the forward ends (22*a*, 23*a*) of opposing gates (22, 23) are rotated to an open position away from the open sector (18) of the ringed body (12) as shown in FIG. 10. When in an open position, the gates (22, 23) extend outward from the body (12) tilting the elevator (10) downward towards the open sector (18). The elevator (10) is then moved and positioned to place pipe segment (P) through the open sector (18) within the ringed body (12) of elevator (10) to engage the gates (22, 23) as shown in FIG. 8.

The weight of the elevator (10) on the pipe (P) against the opposing gates (22, 23) will cause the rearward ends (22*b*, 23*b*) of the gates to rotate in unison on their respective pivot pins (24) to move outward with respect to the central area (20) of the ringed body (12) to compress spring (28) thereby rotating the forward ends (22*a*, 23*a*) of opposing gates (22, 23) inward into the open sector (18) of the ringed body (12) to a closed position around the pipe segment (P) as shown in FIG. 9. The latching mechanism (25) may then be employed to move latch wedge (27) of latch lever (26) against latch block (34) where it will be secured by latch spring (28).

If the pipe segment (P) is vertical it will be necessary for the operator to pull the elevator onto the pipe segment (P) and tilt the elevator (10) back to level so the elevator will swing against the pipe (P) to pivot the gates (22, 23) to a closed position. If the pipe segment (P) to be lifted is positioned horizontally or at an angle from vertical, when the elevator (10) is lowered or moved against the pipe segment (P), the weight of the elevator against the pipe segment (P) on the gates (22, 23) will pivot the gates to a closed position.

The elevator (10) may then be lifted on hangers (5) by links (L) attached to a hoist to allow the elevator (10) to slide along the pipe (P) to a position where the protruding shoulder of the pipe collar (C) is supported upon the gates (22, 23) on the ringed body (12) of the elevator (10) for lifting the pipe (P).

The gates (22, 23) of the elevator (10) may be moved to an open position to remove a pipe (P) by manually pulling the latch lever (26) to disengage the latch wedge (27) from the latch block (34). When the latch edge (27) is disengaged from the latch block (34), spring (28) will extend to pivot gates (22, 23) on their respective pins (24) to move ends (22*a*, 23*a*) to widen open sector (18) of the ringed body as shown in FIG. 8.

What is claimed is:

1. A shoulder elevator comprising:

(a) a ringed body, said ringed body having a central area with an open sector configured to receive a length of pipe wherein one end of said pipe has an outwardly protruding collar around its periphery;

(b) elongated hangers pivotally mounted to said ringed body, said hangers supported on lifting links attached to a hoist;

(c) opposing first and second curved gates pivotally mounted to said ringed body on opposite sides of said open sector of said ringed body, each said curved gate having a forward end and a rearward end, whereby said opposing first and second gates may rotate inward and outward into and away from said open sector of said ringed body;

(d) a spring stop pivotally attached to said rearward end of said first curved gate;

(e) a spring guide rod having first and second ends, said first end of said spring guide rod pivotally attached to said rearward end of said second curved gate, said spring guide rod slidably extending through said spring stop; and (f) a spring mounted on said spring guide rod, said spring extending between said spring stop and said second end of said spring guide rod and biasing said opposing first and second curved gates to at least partially open said open sector of said ringed body;

(g) a lever having first and second ends, said first end of said lever pivotally attached to said first rearward end of said first curved gate;

(h) a wedge at said second end of said lever; and (i) a latch block on said rearward end of said second curved gate whereby pushing said lever inward toward said open sector will compress said spring so that said wedge of said lever bears upon said latch block to rotate said opposing first and second gates to at least partially close said open sector of said ringed body.

2. The elevator as recited in claim 1 wherein said opposing first and second curved gates pivot to at least partially close said open sector of said ringed body in response to contact of said length of pipe with at least one of said opposing first and second curved gates.

3. The elevator as recited in claim 2 wherein said ringed body hangs horizontally on said hangers when said first and second curved gates pivot to at least partially close said open sector of said ringed body.

4. The elevator as recited in claim 3 wherein said pipe is supported by said pipe collar on said first and second gates when said ringed body is lifted on said hangers.

5. The elevator as recited in claim 4 wherein said ringed body tilts toward said open sector of said ringed body when said first and second curved gates are pivoted to at least partially open said open sector of said ringed body.

* * * * *